US005788239A

United States Patent [19]

Kong

[11] Patent Number: 5,788,239

[45] Date of Patent: Aug. 4, 1998

[54] METHOD OF PLAYING A DICE GAME FOR A CASINO

[76] Inventor: Yu Wei Kong, 6288 Pride La., Las Vegas, Nev. 89103

[21] Appl. No.: 729,981

[22] Filed: Oct. 11, 1996

[51] Int. Cl.[6] ..... A63F 3/00

[52] U.S. Cl. ..... 273/274

[58] Field of Search ..... 273/146, 274

[56] References Cited

U.S. PATENT DOCUMENTS

| | | | |
|---|---|---|---|
| 4,909,513 | 3/1990 | Kiyono | 273/145 R |
| 5,224,706 | 7/1993 | Bridgeman et al. | 463/13 |
| 5,259,618 | 11/1993 | Ramos | 273/145 C |
| 5,265,881 | 11/1993 | Doherty | 273/274 |
| 5,350,175 | 9/1994 | DiLullo et al. | 273/146 |
| 5,413,351 | 5/1995 | Franklin | 273/274 |
| 5,513,850 | 5/1996 | Vancura | 273/274 |
| 5,556,101 | 9/1996 | Jabro | 273/274 |

OTHER PUBLICATIONS

*Encyclopedia of Games*, John Scarne, Harper & Row Publishers, pp. 477,478, circa 1983.

SIC-BO brochure by Tripp Plastics, Sparks, NV, date unknown.

"Win" Magazine article on Pai Gow (Asian Poker) pp. 39,40 & 70, dated Apr. 1992.

*Primary Examiner*—Benjamin H. Layno

*Attorney, Agent, or Firm*—Quirk & Tratos

[57] ABSTRACT

A player in a dice game may make two types of wagers against a banker. The winner of a first type of wager is determined by comparing the result of a roll of a pair of dice by a player to the result of a roll of the dice by the banker. The winner of a second type of wager is determined by the result of the roll of the dice by the banker. Combinations that may result from rolling the dice are exhaustively ranked. Several first and second types of wagers depend upon the rank of a combination that results from rolling the dice by player and the rank of a combination that results from rolling the dice by a banker.

10 Claims, 3 Drawing Sheets

METHOD OF PLAYING A DICE GAME FOR A CASINO

FIELD OF THE INVENTION

This invention relates generally to games of chance and, more specifically, to a dice game.

DESCRIPTION OF THE PRIOR ART

Sic Bo and Craps are two dice games most often played in a modern casino. Only a banker rolls the dice during a round of play of Sic Bo. Only one player rolls the dice during a round of play of Craps.

Competing with either a banker or a dealer and a possibility of monetary gain are the most compelling attractions of gambling in a casino. Since only the banker rolls the dice in a round of play in Sic Bo and only the one player rolls the dice in a round of play in Craps, the competition in Sic Bo and Craps is limited.

The competition can be enhanced if the banker and a plurality of players had an opportunity to roll the dice during a round of play. Heretofore, there has not been a dice game with the enhanced competition.

The attraction of a dice game can be heightened by formulating the game to fully exploit different combinations that result from rolling the dice. When, for example, rolling the dice results in an upturned face of one die indicating a two and an upturned face of the other die indicating a five, the numerical outcome is said to be seven, the sum of the numbers indicated on the upturned faces. Similarly when rolling the dice results in the upturned face of one die indicating a four and the upturned face of the other die indicating a three, again the numerical outcome is said to be seven. In other words different combinations that result from rolling the dice can result in the same numerical outcome.

One of the interesting aspects of rolling the dice is that a numerical outcome is one of twenty one combinations. Heretofore, the differences between the combinations have not been fully exploited in formulating a dice game.

SUMMARY OF THE INVENTION

An object of the present invention is to provide a dice game that exploits the differences between the twenty one combinations of numerical outcomes that may be indicated by the upturned faces of a pair of dice.

An object of the present invention is to provide a dice game where a plurality of players have an opportunity to roll a pair of dice during a round of play.

Another object of the present invention is to provide a dice game where a banker, in addition to a plurality of players, has an opportunity to roll a pair of dice during a round of play.

Another object of the present invention is to provide a dice game where a winner of a wager is determined by the result of a roll of the dice by a banker.

According to the present invention, a dice game is predicated upon an exhaustive ranking of the twenty one combinations that may be indicated by the upturned faces of a pair of dice.

When a pair of dice are rolled, there is a numerical outcome that is one of twenty one possible combinations. The invention is a dice game wherein the combinations are exhaustively ranked.

Other objects, features, and advantages of the invention should be apparent from the following description of the preferred embodiment as illustrated in the accompanying drawing.

DESCRIPTION OF THE PREFERRED EMBODIMENT

The present invention is a dice game that utilizes all of the twenty one combinations that may be indicated by the upturned faces of a pair of dice. More particularly, the combinations are exhaustively ranked.

Figure 1:
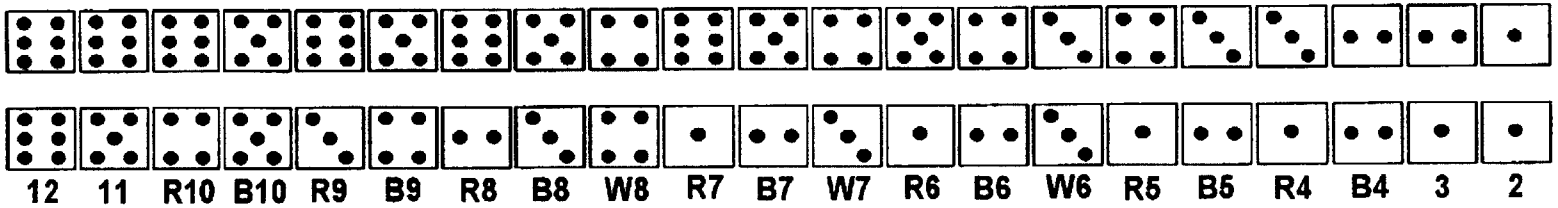
FIG. 1 is a pictorial representation of rankings of the combinations that may be indicated by the upturned faces of a pair dice.

As shown in FIG. 1, the twenty one combinations are numerically designated by the numbers two through twelve, with some of the designations additionally including a literal prefix. The literal prefix is either R, B or W.

The numeric portion of the designation is the sum of the two numbers indicated by the dice. The literal prefix is used to distinguish between combinations that provide identical numerical designations. In the ranking of the combinations, the higher the numerical designation, the higher the ranking.

Where two of the combinations have the same numerical designation, the literal prefix, R, designates the combination with the higher rank and the literal prefix, B, designates the combination with the lower rank. Where three of the combinations have the same numerical designation, the literal prefix, W, designates the combination with the lowest rank. The literal prefixes, R and B, designate the combinations with the two higher ranks as described hereinbefore.

As explained hereinafter, the game is played on a semicircular table top that carries a showing of all but one of the combinations. Preferably, the showing of the combinations that have designations with the literal prefixes, R, B, W, are colored red, blue and white, respectively.

Figure 2:
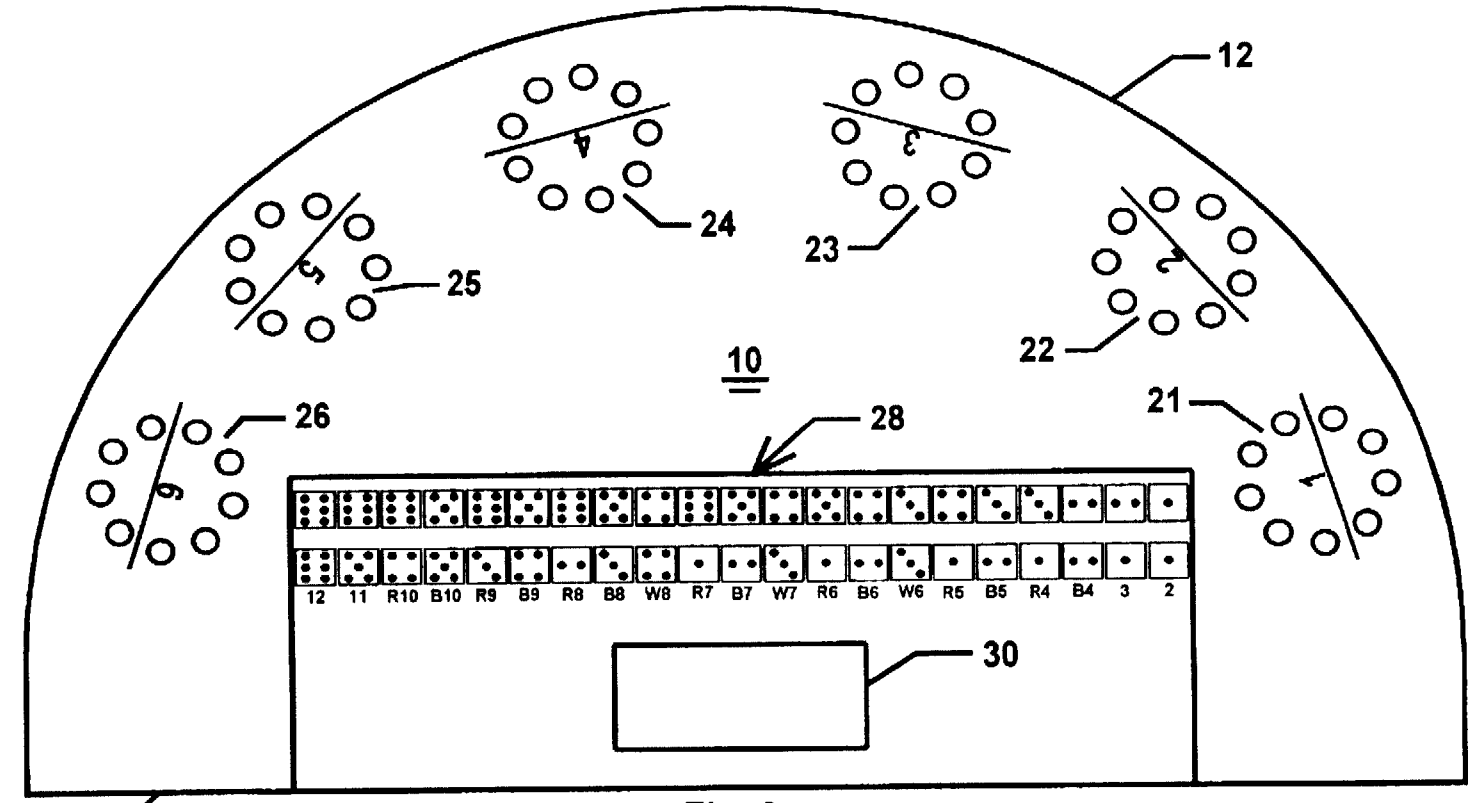
FIG. 2 is a plan view of a table top where a dice game of the present invention is played.

As shown in FIG. 2, the game is played on a table top 10 that has the general shape of a semicircle with an arcuate edge 12 and a straight edge 14. Six player stations are disposed along the edge 12 with substantially equal spacing therebetween. As many as six players and as few as one player may play the game that is described herein. In an alternative embodiment, there may be more than six stations, thereby providing for more than six players.

Adjacent to the six stations, the table top 10 carries similar groups of wagering indicia 21–26, respectively. The indicia of the groups 21–26 are each disposed along the circumference of a circle wherein the numerals 1–6 are respectively carried, thereby providing an indication of the approximate locations of the player stations. The table top 10 additionally carries a wager tally block 28 which is explained hereinafter.

Adjacent to the edge 14 is a check rack 30 where a banker stores wagering tokens, known as chips, and lammers. The banker is typically an employee of a casino where the game is played.

Figure 3:
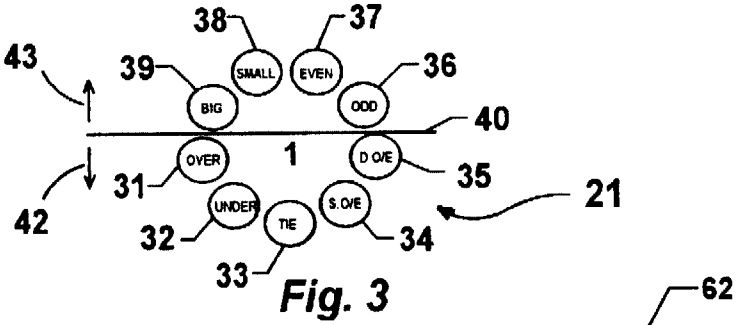
FIG. 3 is an enlarged view of a group of wagering indicia carried on the table top of FIG. 2.

As shown in FIG. 3, the group 16 includes circular wagering indicia 31–39. One or more chips representative of a wager may be placed upon the interior of any of the indicia 31–39 prior to a start of a round of play. As explained hereinafter, a player may make two types of wagers. It should be understood that all wagers are by a player against the banker.

The table top 10 additionally carries a line 40 that divides the group 16. The player at station one makes a first type of wager by placing one or more chips upon any of the indicia 31–39 that are on a side of the line 40 that is indicated by an arrow 42. The winner of the first type of wager is determined by comparing an outcome of the roll of a pair of dice by the station player one to an outcome of a roll of the dice by the banker.

The station one player makes a second type of wager by placing one or more chips upon any of the indicia 31–39 that are on a side of the line 40 that is indicated by an arrow 43. The winner of the second type of wager is determined by an outcome of the roll of the dice by the banker.

The station one player may make a first type of wager known as an OVER wager. The winner of the OVER wager is determined by comparing a combination resulting from the station one player rolling the dice to a combination resulting from the banker rolling the dice. The station one player wins the OVER wager when the station one player's combination has a higher rank than the rank of the banker's combination.

The station one player may make a first type of wager known as an UNDER wager. Like the OVER wager, the winner of the UNDER wager is determined by comparing a combination resulting from the station one player rolling the dice to a combination resulting from the banker rolling the dice. However, the station one player wins the UNDER wager when the station one player's combination has a lower rank than rank of the banker's combination.

The probability of a player winning either the OVER wager or the UNDER wager is approximately 10/21. A payout to the player that wins either the OVER wager or the UNDER wager is in accordance with the probability of winning, with an adjustment to allow for a commission for the casino.

The station one player may make a first type of wager that is known as a TIE wager. Like the OVER wager, the winner of the TIE wager is determined by comparing a combination resulting from the station one player rolling the dice to a combination resulting from the banker rolling the dice. However, the station one player wins the TIE wager when the station one player's combination and the banker's combination have the same rank.

The probability of a player winning the TIE wager is approximately 1/21. A payout to the player that wins the TIE wager is in accordance with the probability of winning, with an adjustment to allow for a commission for the casino.

The station one player may make a first type of wager that is known as a SAME ODD/EVEN wager. The winner of the SAME ODD/EVEN wager is determined by comparing a numerical outcome resulting from the station one player rolling the dice to a numerical outcome resulting from the banker rolling the dice. The station one player wins the SAME ODD/EVEN wager when the station one player's numerical outcome and the banker's numerical outcome are either both odd or both even. In this embodiment, a numerical outcome resulting from rolling the pair of dice is the sum of the numbers indicated by the upturned faces of the pair of dice.

The probability of a player winning the SAME ODD/EVEN wager is 1/2. A payout to the player that wins the SAME ODD/EVEN wager is in accordance with the probability of winning, with an adjustment to allow for a commission for the casino.

The station one player may make a first type of wager that is known as a DIFFERENT ODD/EVEN wager. The winner of the DIFFERENT ODD/EVEN wager is determined by comparing a numerical outcome resulting from the station one player rolling the dice to a numerical outcome resulting from the banker rolling the dice. The station one player wins the DIFFERENT ODD/EVEN wager when the station one player's numerical outcome is even and the banker's numerical outcome is odd or vice versa.

The probability of a player winning the DIFFERENT ODD/EVEN wager is 1/2. A payout to the player that wins the DIFFERENT ODD/EVEN wager is in accordance with the probability of winning, with an adjustment to allow for a commission for the casino.

Lettering of the terms OVER, UNDER, TIE, S. O/E, and D. O/E, are carried on the table top 10 within the indicia 31–35, respectively. The station one player makes the OVER, UNDER, TIE, SAME ODD/EVEN, and DIFFERENT ODD/EVEN wagers by respectively placing one or more chips upon the indicia 31–39.

The station one player may make a second type of wager that is known as an ODD wager. The winner of the ODD wager is determined by a numerical outcome resulting from the banker rolling the dice. The station one player wins the ODD wager when the banker's numerical outcome is odd.

The probability of a player winning the ODD wager is 1/2. A payout to the player that wins the ODD wager is in accordance with the probability of winning, with an adjustment to allow for a commission for the casino.

The station one player may make a second type of wager that is known as an EVEN wager. Like the ODD wager, the winner of the EVEN wager is determined by a numerical outcome resulting from the banker rolling the dice. The station one player wins the EVEN wager when the banker's numerical outcome is even.

The probability of a player winning the EVEN wager is 1/2. A payout to the player that wins the EVEN wager is in accordance with the probability of winning, with an adjustment to allow for a commission for the casino.

The station one player may make a second type of wager that is known as a SMALL wager. The winner of the SMALL wager is determined by a combination resulting from the banker rolling the dice. The station one player wins the SMALL wager when the banker's combination has a rank lower than B7, which is a median combination.

The probability of a player winning the SMALL wager is 17/36. A payout to the player that wins the SMALL wager is in accordance with the probability of winning, with an adjustment to allow for a commission for the casino.

The station one player may make a second type of wager that is known as a BIG wager. The winner of the BIG wager is determined by a combination resulting from the banker rolling the dice. The station one player wins the BIG wager when the banker's combination has a rank greater than B7.

The probability of a player winning the BIG wager is 17/36. A payout to the player that wins the BIG wager is in accordance with the probability of winning, with an adjustment to allow for a commission for the casino.

Lettering of the terms ODD, EVEN, SMALL, and BIG are carried on the table top 10 within the indicia 31–39, respectively. The station one player makes the ODD, EVEN, SMALL and BIG wagers by respectively placing chips upon the interior of indicia 36–39.

It should be understood that after all of the players have made wagers, those players that have placed chips upon any indicia corresponding to the indicia 31–35 each roll the dice once. Thereafter, the banker rolls the dice. As a security measure, a result obtained by a player rolling the dice is recorded on the tally block 28 as described hereinafter.

Figure 4:
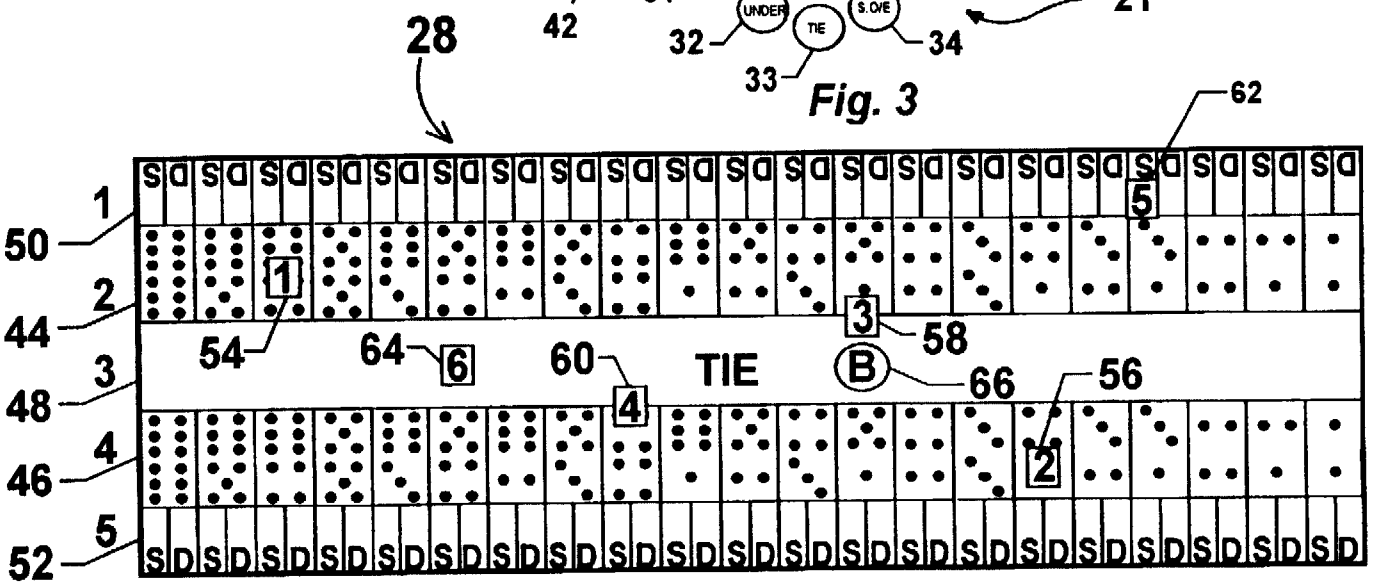
FIG. 4 is an enlarged view of a wager tally block carried on the table top of FIG. 2.

As shown in FIG. 4, the tally block 28 includes an upper row 44 and a lower row 46 of pictorial representations of the combinations of FIG. 1. The rows 44, 46 are parallel to each other with a rectangular space 48 therebetween. Lettering of the word, TIE, is carried centrally within the space 48.

The row 44 is in an abutting relationship with a row 50 of similar rectangles. The rectangles of the row 50 carry therein either the letter, S, or the letter, D. More particularly, each pictorial representation of the row 44 abuts one rectangle wherein the letter, S, is carried and another rectangle wherein the letter, D is carried.

In a similar manner, the row 46 is in an abutting relationship with a row 52 that is similar to the row 50. Like the row 44, each pictorial representation of the row 46 abuts one rectangle wherein the letter, S, is carried and another rectangle wherein the letter, D, is carried.

As an example of a round of play, the station one player makes an OVER wager and the result of the station one player rolling the dice provides the combination, R10. A lammer 54 is placed upon the pictorial representation of the combination, R10, in the row 44. The lammer 54 carries the numeral 1, on each of its faces, thereby indicating an association with the player station number one.

The placement of the lammer 54 upon a pictorial representation of a combination in the row 44 provides a record of the OVER wager made by the station one player. Because the lammer 54 is placed upon the pictorial representation of the combination, R10, a record is provided of the outcome of the rolling of the dice by station one player.

According to the example, the player at station number two makes an UNDER wager and the result of the station two player rolling the dice is the combination, R5. A lammer 56 is placed upon the pictorial representation of the combination, R5, in the row 46. The lammer 56 carries the numeral 2, on each of its faces, thereby indicating an association with the player number two.

The placement of the lammer 56 upon a pictorial representation of a combination in the row 46 provides a record of the UNDER wager made by the station three player. Because the lammer 56 is placed upon the pictorial representation of the combination, R5, a record is provided of the outcome of the rolling of the dice by the station two player.

In further accord with the example, the player at station number three makes an OVER wager and a TIE wager. The result of the station two player rolling the dice is the combination, R6. A lammer 58 is placed partially upon the pictorial representation of the combination, R6, in the row 44 and partially within the space 48. The lammer 58 carries the numeral 3, on each of its faces, thereby indicating an association with the player number three.

The placement of the lammer 58 partially upon a pictorial representation of a combination in the row 44 and partially within the space 48 provides a record of the OVER and TIE wagers made by the station three player. Because the lammer 58 is placed upon the pictorial representation of the combination, R6, a record is provided of the outcome of the rolling of the dice by the station three player.

The example additionally includes, the player at station number four making an UNDER wager and a TIE wager. The result of the station four player rolling the dice is the combination, W8. A lammer 60 is placed partially upon the pictorial representation of the combination, W8, in the row 46 and partially within the space 48. The lammer 60 carries the numeral 4, on each of its faces, thereby indicating an association with the player number four.

The placement of the lammer 60 partially upon a pictorial representation of a combination in the row 46 and partially within the space 48 provides a record of the UNDER and TIE wagers made by the station four player. Because the lammer 60 is placed upon the pictorial representation of the combination, B8, a record is provided of the outcome of the rolling of the dice by the station four player.

The example additionally includes, the player at station number five making a SAME ODD/EVEN wager. The result of the station five player rolling the dice is the combination, R4. A lammer 62 is placed upon a rectangle, that carries the letter S, that abuts the pictorial representation of the combination, R4, in the row 44. The lammer 62 carries the numeral 5, on each of its faces, thereby indicating an association with the player number five.

The placement of the lammer 62 upon a rectangle that carries the letter, S, provides a record of the SAME ODD/EVEN wager made by the station five player. Because the lammer 62 is placed a rectangle that abuts the pictorial representation of the combination, R4, a record is provided of the outcome of the rolling of the dice by the station five player.

Lastly, according to the example, the player at station number six makes a TIE wager and the result of the station six player rolling the dice is the combination, B9. A lammer 64 is placed within the space 58 between the pictorial representations of the combination, B9, in the rows 44, 46. The lammer 64 carries the numeral 6, on each of its faces, thereby indicating an association with the player number six.

The placement of the lammer 64 within the space 48 provides a record of the TIE wager made by the station six player. Because the lammer 64 is placed between the pictorial representations of the combination, B9, a record is provided of the outcome of the rolling of the dice by the station six player.

In the example, the result of the banker rolling the dice is the combination, R5. A lammer 66 that carries the letter, B, is placed within the space 48 between the pictorial representations of the combination, R5, in the rows 44, 46.

Typically, when the game is played, the dice are rolled upon the table top 10 from a cup (not shown). The dice are placed in the cup with upturned faces thereof indicating the combination, B7. As a security measure, when the combination B7, results from rolling the dice, the result is deemed unacceptable; the rolling of the dice is repeated.

While the invention has been particularly shown and described with reference to a preferred embodiment thereof, it will be understood by those skilled in the art that changes in form and detail may be made therein without departing from the spirit and scope of the invention.

I claim:

1. In the method of playing a game where a player makes a wager against a banker, the steps of:

providing a pair of dice, each die having six faces, and each face having a number of spots from one to six spots;

exhaustively ranking the twenty one combinations that may be indicated by upturned faces of said dice as an outcome of said dice being rolled;

rolling said pair of dice by said player;

rolling said pair of dice by said banker;

comparing the rank of the outcome of the roll of said dice by said player to the rank of the outcome of the roll of said dice by said banker to determine the winner of said wager.

2. In the method of claim 1, the additional steps of:

providing a table top that carries wagering indicia with lettering that denotes a name of a wager and a wager tally block;

placing of a wagering token by said player upon a selected wagering indicia; and placing a lammer on said tally block at a location that indicates the combination resulting from said player rolling said dice and a name of a wager denoted by said lettering within said selected wagering indicia.

3. In the method of claim 1, wherein said player wins said wager when the rank of the outcome of the roll by said player is of higher rank than the rank of the outcome of the roll by said banker.

4. In the method of claim 1, wherein said player wins said wager when the rank of the outcome of the roll by said player is of lower rank than the rank of the outcome of the roll by said banker.

5. In the method of claim 1, wherein said player wins said wager when the rank of the outcome of the roll by said player and the rank of the outcome of the roll by said banker are equal.

6. In the method of playing a dice game where a player makes a wager against a banker, the steps of:

providing only two identical dice, each die having six faces, and each face having a number of spots from one to six spots;

exhaustively ranking the twenty one combinations that may be indicated by upturned faces of said dice as an outcome of said dice being rolled;

rolling said dice by said banker; and comparing the rank of the outcome of the roll of said dice by said banker to the rank of a known combination to determine the winner of said wager.

7. In the method of claim 6 wherein said player wins said wager in response to the outcome of the roll of said dice being a combination having a higher rank than said known combination.

8. In the method of claim 6 wherein said player wins said wager in response to the outcome of the roll of said dice being a combination having a lower rank than said known combination.

9. A method of a banker and a player playing a dice game comprising the steps of:

providing a pair of dice, each die having six faces, and each face having a number of spots from one to six spots exhaustively ranking to the twenty one combinations that may be indicated by upturned faces of said pair of dice as an outcome of said dice being rolled;

a player having an option of making any of the following wagers, (i) over, (ii) under, (iii) tie, (iv) same, odd or even, and (v) different, odd or even;

said player rolling said dice, thereby providing a player numerical outcome and a player combination;

said banker rolling said dice, thereby providing a banker numerical outcome and a banker combination;

said wagers being reconciled as follows, (i) said player wins said over wager when said player combination has a higher rank than said banker combination, (ii) said player wins said under wager when said banker combination has a higher rank than said player combination, (iii) said player wins said tie wager when said player combination is equal in rank to said banker combination, (iv) said player wins said same odd or even wager when said player and banker numerical outcomes are either both odd or both even, and (v) said player wins said different odd or even wager when said player numerical outcome is odd and said banker numerical outcome is even or vice versa.

10. The method of claim 7 where said player additionally has an option of making any of the following wagers, (vi) odd, (vii) even, (viii) small, and (ix) big said wagers being reconciled as follows, (vi) said player wins said odd wager when said banker numerical outcome is odd, (vii) said player wins said even wager when said banker numerical outcome is even, (viii) said player wins said small wager when said banker combination has a rank less than a predetermined rank (ix) said player wins said big wager when said banker combination has a rank greater than a predetermined rank.

* * * * *